US011145240B2

(12) United States Patent
Koo et al.

(10) Patent No.: US 11,145,240 B2
(45) Date of Patent: Oct. 12, 2021

(54) DYNAMIC SCALING OF CONTENT LUMINANCE AND BACKLIGHT

(71) Applicant: ATI TECHNOLOGIES ULC, Markham (CA)

(72) Inventors: Anthony W L Koo, Markham (CA); Syed Athar Hussain, Markham (CA); Krunoslav Kovac, Markham (CA)

(73) Assignee: ATI TECHNOLOGIES ULC, Markham (CA)

( * ) Notice: Subject to any disclaimer, the term of this patent is extended or adjusted under 35 U.S.C. 154(b) by 0 days.

(21) Appl. No.: 16/146,731

(22) Filed: Sep. 28, 2018

(65) Prior Publication Data

US 2020/0105182 A1 Apr. 2, 2020

(51) Int. Cl.
*G09G 3/22* (2006.01)
*G09G 3/36* (2006.01)

(52) U.S. Cl.
CPC ..... *G09G 3/22* (2013.01); *G09G 3/3625* (2013.01); *G09G 2320/0626* (2013.01); *G09G 2320/0646* (2013.01); *G09G 2320/0686* (2013.01); *G09G 2360/144* (2013.01)

(58) Field of Classification Search
CPC ..... G09G 3/22; G09G 2320/0626; G09G 2360/144; G09G 3/3625; G09G 2320/0686; G09G 2320/0646
See application file for complete search history.

(56) References Cited

U.S. PATENT DOCUMENTS

2012/0268436 A1* 10/2012 Chang ..... G09G 3/34 345/207
2015/0213781 A1* 7/2015 Huang ..... G09G 5/10 345/207
2016/0093243 A1* 3/2016 Su ..... G09G 3/2003 345/690

* cited by examiner

*Primary Examiner* — Jonathan A Boyd

(57) ABSTRACT

A method for dynamic scaling of content luminance and backlight level includes determining, using one or more processors of a display system, an ambient light level of a local environment proximate the display system. Based on the ambient light level being brighter than a first ambient light threshold, it is determined that the display system is in a normal room or a bright environment. A minimum viewable threshold representing a minimum pixel luminance value perceivable by a user in the ambient light level of the local environment is determined. The method further includes generating a modified display image by shifting the pixel luminance values of one or more pixels of an input image such that a darkest pixel value of the modified display image is equal to or greater than the minimum viewable threshold before transmitting the modified display image for display.

15 Claims, 5 Drawing Sheets

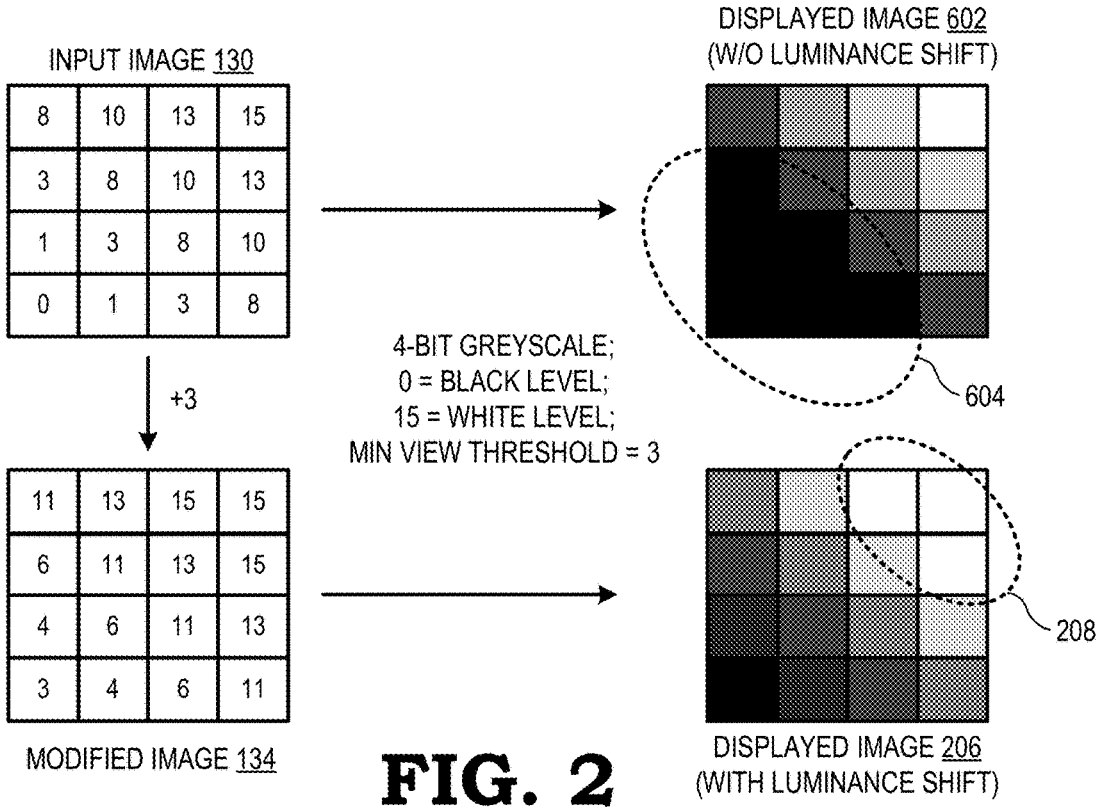
FIG. 2
FIG. 3
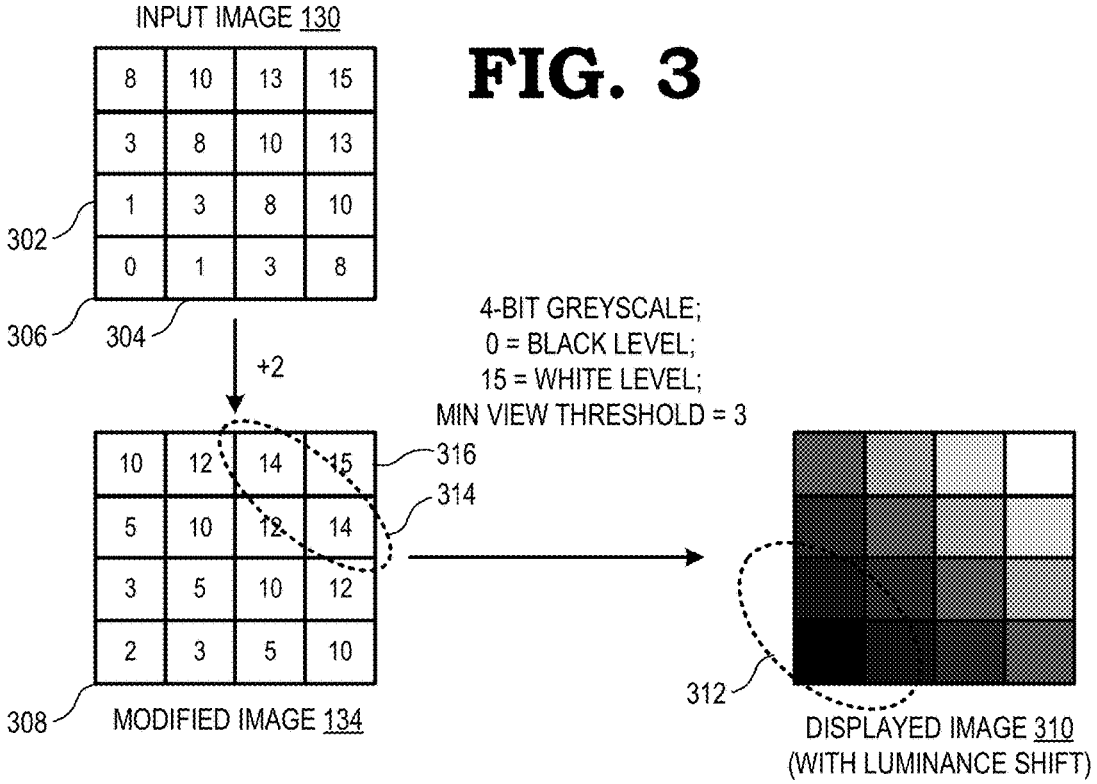

DYNAMIC SCALING OF CONTENT LUMINANCE AND BACKLIGHT

BACKGROUND

Display devices, including portable electronic devices, are used in a multitude of ambient light conditions, which can affect a user's perception of the displayed content on such devices. The human vision system has some ability to adapt to these different ambient lighting conditions. However, even with these adaptive abilities, in different ambient light conditions, a user will perceive the display differently, and in some ambient light conditions the user's perception of the display will be degraded. For example, a dim display may be hard to see in bright ambient light conditions.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

FIG. 2 is a diagram illustrating an example of content luminance shifting in accordance with some embodiments.

FIG. 3 is a diagram illustrating another example of content luminance shifting in accordance with some embodiments.

DETAILED DESCRIPTION

Various display devices use an ambient light detector to measure a current brightness level of the ambient light and adjusts a brightness value of a backlight based on the ambient light to conserve power. However, display devices often include transmissive display devices such as LCDs (i.e., LCDs depend on the quantity and quality of the backlight source for producing perceived color gamut) in which reduction of backlight brightness alone results in an image that a user often perceives as of lower quality than the same image with a brighter backlighting.

To increase picture quality while also adjusting for viewing conditions, FIGS. 1-6 describe techniques for dynamically controlling image brightness and/or backlight intensity based on ambient light levels. In one embodiment, a method for dynamic scaling of content luminance includes determining, using one or more processors of a display system, an ambient light level of a local environment proximate the display system. Based on the ambient light level being brighter than a first ambient light threshold, it is determined that the display system is in an environment of a specified type, such as a normal room or a bright environment. A minimum viewable threshold representing a minimum pixel luminance value perceivable by a user in the ambient light level of the local environment is determined. The method further includes generating a modified display image by shifting the pixel luminance values of one or more pixels of an input image such that a darkest pixel value of the modified display image is equal to or greater than the minimum viewable threshold before transmitting the modified display image for display. In this manner, the source content has its luminance values adjusted to more closely map to content intended to be displayed, as well as dynamically adjusted for different scenes and local viewing environments.

Figure 1:
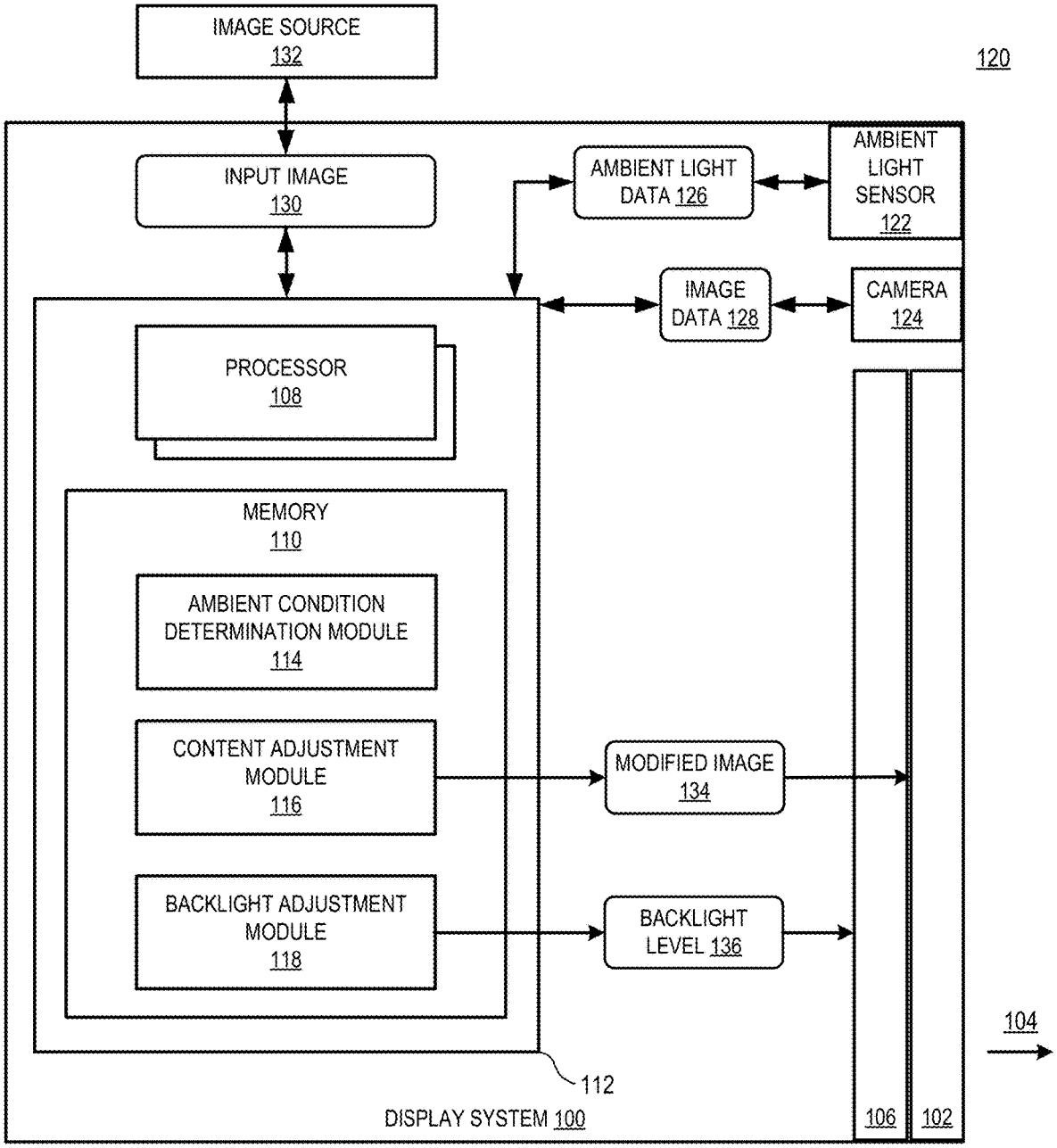
FIG. 1 is a block diagram illustrating a display system for dynamically scaling content luminance and backlight brightness in accordance with some embodiments.

FIG. 1 is a block diagram illustrating a display system 100 for dynamically scaling content luminance and backlight brightness in accordance with some embodiments. In various embodiments, the display system 100 includes a portable electronic apparatus such as, for example, a mobile device, a computing device such as a tablet computer, a laptop computer, a notebook computer, a wearable device, a personal digital assistants (PDA), and the like. In other embodiments, the display system 100 includes a computer monitor containing an embedded computer, a media player, or other handheld or portable electronic device, a smaller device such as a wrist-watch device, a pendant device, a headphone or earpiece device, a device embedded in eyeglasses or other equipment worn on a user's head, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment capable of presenting imagery for display to a user.

The display system 100 includes a display screen 102 facing in a first direction 104 (e.g., a front-facing direction with respect to the display system 100) to present content including still and/or video imagery for display to a user. The display system 100 includes a backlight 106 positioned behind the display screen 102 configured to illuminate the display screen 102 from behind. In some embodiments, the backlight 106 is a cold cathode fluorescent lamp (CCFL) or a light emitting diode (LED) backlight. In some embodiments, the display screen 102 is a liquid crystal display (LCD) device including a backlight for producing light that is transmitted through a layer of liquid crystal material. In various embodiments, the brightness of backlight 106 is adjusted by the one or more processors 108 to provide appropriate brightness based on ambient conditions, and/or to compensate for image intensity changes. The color intensity values for pixels of the display screen 102 is also adjusted based on ambient conditions and/or backlight intensity.

It should be noted that although described here in the context of a LCD display, embodiments can be practiced with any electronic image-producing assembly. Thus, in various embodiments, other displays could be used, such as without limitation, plasma, light-emitting polymer, and organic light emitting diode (OLED) displays. When the display type does not include a traditional backlight, then the term "backlight" can be replaced with "display" and the term "backlight level", can be replaced with "display level."

The display system 100 includes one or more processors 108 (e.g., a CPU, GPU, or combination thereof) and a memory 110. In some embodiments, such as shown in FIG. 1, the one or more processors 108 and the memory 110 are integral parts of a single integrated circuit (IC) chip 112 or a chipset. Alternatively, in other embodiments, the one or more processors 108 and the memory are discrete components separate from each other (e.g., each packaged in an individual chip). Memory 110 includes any type of random access memory (RAM), any type of read-only memory (ROM), or any suitable memory device configured to store data and one or more sets of instructions which may be in the form of software, middleware or firmware modules. Modules stored in memory device 110 are executable by the one or more processors 108 to perform a number of operations. In the example shown of FIG. 1, the memory 110 stores an ambient condition determination module 114, a content adjustment module 116, and a backlight adjustment module 118, each of which is executable by the one or more processors 108. Each of the ambient condition determination module 114, the content adjustment module 116, and the backlight adjustment module 118 is a software, middleware or firmware module executable by hardware circuits of one or more processors 108. In other embodiments, one or more of these modules can be a hardware module.

The ambient condition determination module 114 causes the one or more processors 108 to determine an ambient condition of a local environment 120 external to the display system 100. In one embodiment, the display system 100 includes an ambient light sensor 122 and a camera 124. In various other embodiments, the display system 100 alternatively includes only one of these light detecting devices or any number of light detecting devices. The ambient light sensor 122 detects an ambient light level and generates ambient light data 126 representing the brightness and/or a color condition of ambient light surrounding the display system 100 in the local environment 120. The ambient light sensor 122, in various embodiments, generates the ambient light data 126 as output that is in proportion to the amount of ambient light incident on the ambient light sensor 122. In some examples, the light sensor 122 is a photodiode, phototransistor, or other light sensitive electronic device that produces an output that is measured to determine an estimate of ambient light. In some embodiments, the one or more processors 108 receives ambient light data 126 from the ambient light sensor 122 and processes the ambient light data 126 to generate luminance data (not shown) and ambient light color data (not shown). In other embodiments, the ambient condition determination module 114 receives the ambient light data 126 from the ambient light sensor 122 and processes the ambient light data 126 to generate luminance data and ambient light color data.

The camera 124 operates to capture images for either still pictures of video and generate image data 128. In some examples, the camera 124 includes a complementary metal-oxide-semiconductor (CMOS) light sensor and/or a charge coupled device (CCD) light sensor. In one embodiment, the one or more processors 108 receives the image data 128 and analyzes the image data 128 to determine ambient light conditions of the local environment 120 upon capture. In some embodiments, software and/or hardware logic may be utilized to determine luminance of the image data 128 associated with images captured by the camera 124. In other embodiments, the ambient condition determination module 114 receives the image data 128 and analyzes the image data 128 to estimate an ambient light level of the local environment 120. The one or more processors 108 and the ambient condition determination module 114 determines an estimate of ambient light levels by, for example, summing or averaging the intensity of each pixel of one or more images captured by the camera 124. Those skilled in the art will appreciate that other light characteristics (e.g., correlated color temperature) may also be determined through an analysis of the images captured by the camera 124 and through analysis of data captured by the ambient light sensor 122 to adjust properties of content for display on the display screen 102.

As generally understood by those skilled in the art, light detection in the human eye is enabled by two types of cells, cones and rods. The cone-shaped cells of the retina are sensitive in bright light conditions (e.g., photopic vision), with visual sensitivity and the ability to see greater detail and color depending on brightness of the viewing environment. In contrast, the rod-shaped cells are sensitive in dim light, in which the photo-pigment rhodopsin increases in the rod-shaped cells and improves their sensitivity. In dim ambient light conditions, the cones do not receive enough light for chemical reactions to take place and their contributions to vision diminishes. Additionally, the pupils of the eye increase or decrease in size, depending upon the amount of ambient light. In dim light, the pupils of the eyes dilate to let in more light; in bright light, the pupils constrict to let in less light.

In various conditions, content displayed on the display screen 102 appears to the human eye as too dark, with an amount of perceivable detail lost when viewed in bright ambient light conditions without sufficient pixel luminance and backlight brightness (e.g., two or more different black pixels become indistinguishable from each other). This is especially true for high dynamic range (HDR) content, as HDR content often contains a large amount of content in the darker regions due to use of 10-bit color depth that results in an expanded range of color shades and reduction of gradations between shades of colors. However, even though two pixels may be addressed with differing black values (e.g., greyscale value for shades of black), the two pixels are perceived as the same black when the local environment 120 is too bright. Depending on the brightness of the local environment 120, the value of a first pixel value to a second pixel value requires a difference in luminance of some value before the human eye perceives a difference. Accordingly, as discussed in more detail below, the display system 100 dynamically scales content luminance of imagery presented for display by the display screen 102 and/or brightness of the backlight 106 based on ambient light conditions of the local environment 120 (e.g., based on data captured by the ambient light sensor 122 and the camera 124).

The content adjustment module 116 receives an input image 130 (or a plurality of images forming a video file) to be rendered for display from an image source 132. In various embodiments, the image source 132 includes devices which generate, receive or transmit image and video data, including but not limited to television/cable/satellite transmitters, DVD/Blue Ray players, media storage devices, computers, video recorders, video gaming systems, HDMI input, and the like. In other embodiments, the image source 132 includes a data interface connection such a network connection to streaming video content. However, those skilled in the art will recognize that the image source 132 can include any number of sources and devices capable of providing imagery to the display system 100 without departing from the scope of this disclosure.

The one or more processors 108 define a minimum viewable threshold correlating with the ambient lighting in the local environment 120. The minimum viewable threshold represents a number of nits luminance (i.e., a measurement of how much light the display screen 102 outputs equal to one candela per square meter—a standardized measurement of luminous intensity) required for a viewer to distinguish details and contrast in dark regions of displayed content.

Accordingly, when the display system 100 is in a bright environment (e.g., as determined by the ambient condition determination module 114 based on the ambient light data 126 and image data 128) based on the ambient light level being brighter than a first ambient light threshold, the content adjustment module 116 modifies the received input image 130 by shifting pixels below the minimum viewable threshold upwards such that the shifted pixels are equal to or greater than the minimum viewable threshold. In one embodiment, the content adjustment module 116 raises the black level (i.e., lowest output) of a modified display image 134 transmitted to the display screen 102 for display such that the displayed luminance of the black level is equal to or greater than the minimum viewable threshold for a given viewing environment, thereby preserving visual discernment of details in darker regions of the input image 130. Although discussed here primarily in the context of generating the modified display image 134, various embodiments also include the backlight adjustment module 118 setting a backlight level 136 such that the black level of imagery is equal to or greater than the minimum viewable threshold when the modified display image 134 is displayed at the display screen 102.

Alternatively, when the display system 100 is in a dim environment (e.g., as determined by the ambient condition determination module 114 based on the ambient light data 126 and image data 128) based on the ambient light level being dimmer than a first ambient light threshold, the human eye is able to discern more details in dark content due to the pupils being dilated, as discussed above. Accordingly, the backlight adjustment module 118 lowers the blacklight 106 via blacklight level 136 to produce darker pixels for display. Further, the content adjustment module 116 modifies the received input image 130 to display even darker content details that is not possible in a normal room ambient level. For example, as described in more detail below, in various embodiment the content adjustment module 116 generates a modified display image 134 by shifting the pixel luminance values of one or more pixels of the input image 130 based on the step value such that more image details are perceivable in the modified display image 134 than the input image 130, thereby increasing the amount of perceivable detail.

FIG. 2 is a diagram illustrating an example of content luminance shifting in accordance with some embodiments. In the example of FIG. 2, a 4-bit greyscale color scheme and a 4×4 pixel image is provided for ease of illustration and description. In this example 4-bit greyscale color scheme, a bit value of 0 corresponds to the black level and a bit value of 15 corresponds to the white level. However, those skilled in the art will recognize that imagery of any size and various color-coding schemes (e.g., 8-bit color, 10-bit color for HDR, 12-bit color, and the like) may be used without departing from the scope of this disclosure.

As shown, a source image to be output to a display for viewing (e.g., input image 130 of FIG. 1) includes pixels encoded with bit values ranging from 0 to 15. In one example, the display system 100 is in a room with ambient conditions (e.g., as determined by the ambient condition determination module 114 based on the ambient light data 126 and image data 128 of FIG. 1) under which the minimum viewable threshold is at a luminance level corresponding to a 4-bit greyscale value of 3. Accordingly, transmitting the input image 130 to the display screen 102 results in a displayed image 202 being perceived by the viewer. However, each of the pixels 204 in the displayed image 202 (e.g., which correspond to the pixels having bit values of 0, 1, and 3 in the input image 130) is at or less than the minimum viewable threshold. Accordingly, each of the pixels 204 is perceived as the same shade of black even though the pixels are encoded with different pixel values. In this manner, an amount of detail encoded into the darker regions of the input image 130 is lost due to ambient light conditions of the viewing environment (e.g., local environment 120).

To recover the details such that contrast between the dark pixels is distinguishable, in some embodiments, the content adjustment module 116 identifies a linear shift value corresponding to a difference between the minimum viewable threshold (e.g., 4-bit greyscale value of 3 in this example) and a darkest pixel value of the input image 130. In this example, the content adjustment module 116 identifies 3 as the linear shift value and adds the linear shift value to the pixel value of each of the pixels of the input image 130.

In this manner, the content adjustment module 116 modifies the input image 130 by shifting pixels below the minimum viewable threshold up such that the shifted pixels are equal to or greater than the minimum viewable threshold, thereby generating the modified display image 134. In particular, the content adjustment module 116 raises the black level (i.e., lowest output) of the modified display image 134 such that the displayed luminance of the black level is equal to or greater than the minimum viewable threshold for a given viewing environment, thereby preserving visual discernment of details in darker regions of the input image 130. Accordingly, transmitting the modified display image 134 to the display screen 102 results in a displayed image 206 being perceived by the viewer. The displayed image 206 includes pixels in the darker regions which are discernable relative to each other (i.e., pixels corresponding to bit values of 3, 4, and 6 of the modified display image 134).

Due to the linear shifting of luminance values, addition of the linear shift value to the pixel value of each of the pixels of the input image 130 sometimes exceeds the white level (e.g., 15 in the example of FIG. 2) or a max luminance value presentable by the display screen 102 (i.e., dependent upon operating characteristics unique to a display screen). Accordingly, in some embodiments, the content adjustment module 116 clamps a pixel value of one or more pixels of the modified display image 134 to be no higher than the max luminance value presentable by the display screen 102 (e.g., often assigned to a white level representing the brightest white). However, in some instances, applying a linear shift to all pixels of the input image 130 results in white-washing of certain portions of the modified display image 134, especially in circumstances with images containing a large amount of dark content and/or in bright viewing environments (e.g., viewing a phone screen in direct sunlight).

For example, each of the pixels 208 in the displayed image 206 is displayed at the white level (e.g., bit value 15 corresponding to the max luminance presentable by display screen 102) according to the modified display image 134. Accordingly, each of the pixels 208 is perceived as the same shade of white even though the pixels were originally encoded with different pixel values in the input image 130. In this manner, an amount of detail encoded into the brighter regions of the input image 130 is lost due to applying a flat, linear shift to each of the plurality of pixels of the input image 130.

In some embodiments, various other luminance shifts are applied to the input image 130 that balance the interests of preserving contrast in darker regions of the input image 130 while limiting white-washing in the modified display image 134. FIG. 3 is a diagram illustrating another example of content luminance shifting in accordance with some embodiments. In the example of FIG. 3, a 4-bit greyscale color scheme and a 4×4 pixel image is provided for ease of illustration and description. In this example 4-bit greyscale color scheme, a bit value of 0 corresponds to the black level and a bit value of 15 corresponds to the white level. However, those skilled in the art will recognize that imagery of any size and various color-coding schemes (e.g., 8-bit color, 10-bit color for HDR, 12-bit color, and the like) may be used without departing from the scope of this disclosure.

As shown, a source image to be output to a display for viewing (e.g., input image 130 of FIG. 1) includes pixels encoded with bit values ranging from 0 to 15. In one example, the display system 100 is in a room with ambient conditions (e.g., as determined by the ambient condition determination module 114 based on the ambient light data 126 and image data 128 of FIG. 1) under which the minimum viewable threshold is at a luminance level corresponding to a 4-bit greyscale value of 3.

To retain some of the details such that contrast between the dark pixels is distinguishable, in some embodiments, the content adjustment module 116 identifies a minimum viewable threshold (e.g., 4-bit greyscale value of 3 in this example). However, rather than shifting all pixels of the input image 130 to be equal to or greater than the minimum viewable threshold (such as described relative to FIG. 2), the content adjustment module 116 identifies a linear shift value that increases visual discernment of details in darker regions of the input image 130 while allowing a predetermined amount of detail encoded into the darker regions of the input image 130 to be lost.

For example, as illustrated in FIG. 3, the content adjust module 116 identifies 2 as the linear shift value and adds the linear shift value to the pixel value of each of the pixels of the input image 130. In this manner, the content adjustment module 116 modifies the input image 130 by shifting pixel 302 and pixel 304 of the input image 130 which are below the minimum viewable threshold up such that the shifted pixels are equal to or greater than the minimum viewable threshold, thereby generating the modified display image 134.

Pixel 308 of the modified display image 134 (which corresponds to pixel 306 of the input image 130) only has a bit value of 2 which is still below the minimum viewable threshold corresponding to a grey-scale bit value of 3. Thus, the content adjustment module 116 raises the black level (i.e., lowest output) of the modified display image 134 to luminance of bit value 2. Transmitting the modified display image 134 of FIG. 3 results in a displayed image 310 being perceived by the viewer. The displayed image 310 includes pixels in the darker regions which are discernable relative to each other (i.e., the pixels corresponding to bit value of 5 vs. the pixels corresponding to bit values of 2 and 3 of the modified display image 134), which is an improvement over losing all contrast between dark pixels in displayed image 202 of FIG. 2. However, an amount of detail is lost due to pixels 312 of the displayed image 310 (which correspond to pixels 302, 304, and 306 of the input image 130) all being perceived as the same shade of black even though pixel 306 was originally encoded with a different pixel value relative to pixels 302, 304 in the input image 130. However, this loss of contrast detail in one pixel of the displayed image 310 is determined to be acceptable.

In this manner, the content adjustment module 116 increases visual discernment of details in darker regions of the input image 130 while allowing a predetermined amount of detail (e.g., one pixel's worth in this example) encoded into the darker regions of the input image 130 to be lost, thereby considering an amount of content below the minimum viewable threshold and an amount of precision that may be lost due to shifting all pixel values up. Although described herein the context of losing a single pixel worth of contrast detail, those skilled in the art will recognize that any number or percentage of pixel contrast loss may be predetermined to be acceptable based on, but not limited to, ambient light levels in the viewing environment, average luminance of pixels in the source content (e.g., input image 130), minimum luminance of pixels in the input image 130 (which does not necessarily need to be black), maximum luminance of pixels in the input image 130 (which does not necessarily need to be white), a range between the minimum luminance and the maximum luminance of pixels in the input image 130, and the like.

As previously described, due to the linear shifting of luminance values, addition of the linear shift value to the pixel value of each of the pixels of the input image 130 sometimes exceeds the white level (e.g., 15 in the example of FIG. 3) or a max luminance value presentable by the display screen 102 (i.e., dependent upon operating characteristics unique to a display screen). In some instances, applying the same linear shift to all pixels of the input image 130 results in white-washing of certain portions of the modified display image 134, especially in circumstances with images containing a large amount of dark content and/or in bright viewing environments (e.g., viewing a phone screen in direct sunlight). Accordingly, in some embodiments, the content adjustment module 116 compresses the linear shifting at brighter regions of the input image 130 to retain an amount of detail encoded into the brighter regions of the input image 130 that would otherwise be lost due to applying the linear shift from the darker regions of the input image 130 (e.g., bit value of 2 in the example of FIG. 3) to the brighter regions of the input image 130.

For example, the pixels 314 of the modified image 134 were originally encoded with a different pixel value in the input image 130 (i.e., grey-scale bit value of 13) than the pixel value of pixel 316 (i.e., grey-scale bit value of 15). Applying the same linear shift from the darker regions of the input image 130 (e.g., bit value of 2 in the example of FIG. 3) to generate the modified image 134 would result in all of pixels 314 and 316 in the displayed image 310 to be displayed at the white level (e.g., bit value 15 corresponding to the max luminance presentable by display screen 102) and perceived as the same shade of white even though the pixels were originally encoded with different pixel values in the input image 130.

Accordingly, in some embodiments, the content adjustment module 116 applies a compressed luminance shift by increasing the pixel values of pixels 314 by a second linear shift amount (e.g., grey-scale bit value of 1 in the example of FIG. 3) that is lesser than the linear shift amount applied to darker pixels of the input image 130 (e.g., grey-scale bit value of 2 in the example of FIG. 3). In this manner, the content adjustment module 116 increases the luminance values of the modified display image 134 as a whole to prevent unintended contrast changes while retaining an amount of detail encoded into the brighter regions of the input image 130 that would otherwise be lost due to applying the same linear shift across all pixels. Additionally, in other embodiments such as described below in more detail relative to FIG. 6, the content adjustment module 116 applies a partial luminance shift by increasing the luminance values of a subset of all pixels in an image without a compressed luminance shift at the top range (e.g., brighter regions) of the input image 130.

Those skilled in the art will recognize the compression point (e.g., luminance at which compressed shifting begins) and the compressed shift value (e.g., second linear shift value lesser than the first linear shift value) can based on, but not limited to, ambient light levels in the viewing environment, average luminance of pixels in the source content (e.g., input image 130), minimum luminance of pixels in the input image 130 (which does not necessarily need to be black), maximum luminance of pixels in the input image 130 (which does not necessarily need to be white), luminance range of the content to be displayed (e.g., a range between the minimum luminance and the maximum luminance of pixels in the input image 130), and the like.

Figure 4:
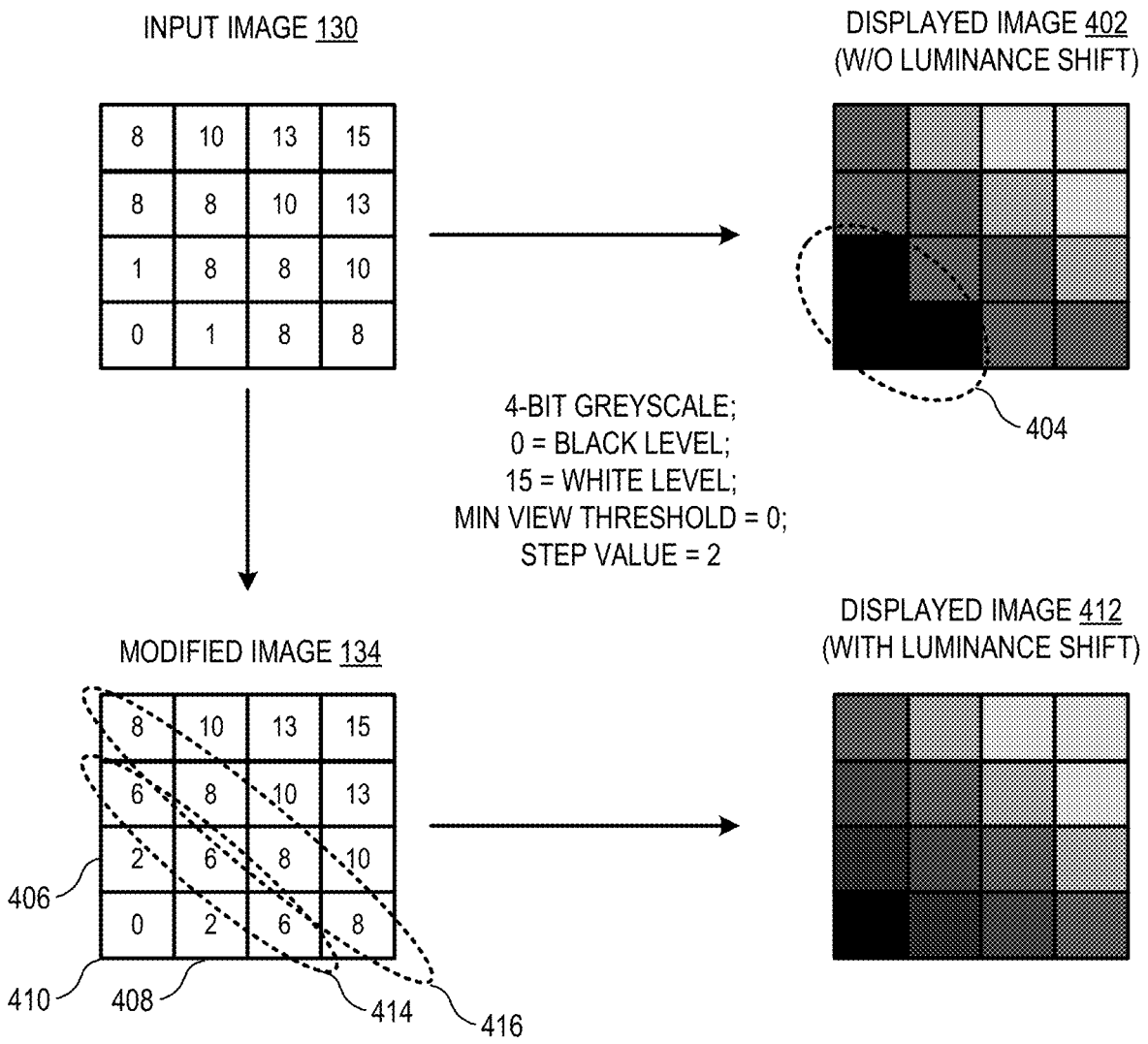
FIG. 4 is a diagram illustrating an example of content luminance shifting to increase perceivable content details in accordance with some embodiments.

As previously discussed, the human eye is capable of discerning more details in dark environments. By knowing a correlation between back light level and the actual luminance of something that shows up on the display, the content adjustment module 116 and the backlight adjustment 118 are capable of increasing amounts of perceivable detail in darker regions of the input image 130. FIG. 4 is a diagram illustrating an example of content luminance shifting to increase perceivable content details in accordance with some embodiments.

In the example of FIG. 4, a 4-bit greyscale color scheme and a 4×4 pixel image is provided for ease of illustration and description. In this example 4-bit greyscale color scheme, a bit value of 0 corresponds to the black level and a bit value of 15 corresponds to the white level. However, those skilled in the art will recognize that imagery of any size and various color-coding schemes (e.g., 8-bit color, 10-bit color for HDR, 12-bit color, and the like) may be used without departing from the scope of this disclosure.

As shown, a source image to be output to a display for viewing (e.g., input image 130 of FIG. 1) includes pixels encoded with bit values ranging from 0 to 15. In one example, the display system 100 is in a dim room with ambient conditions (e.g., as determined by the ambient condition determination module 114 based on the ambient light data 126 and image data 128 of FIG. 1) under which the minimum viewable threshold is at a luminance level corresponding to a 4-bit greyscale value of 0.

Further, under the ambient conditions of the dim room, the viewer's eyes can discern a certain step value (e.g., 4-bit greyscale value of 2 in the example of FIG. 4). The step value represents a minimum luminance change perceivable from a first pixel to a second pixel by a user in the ambient light level of the particular local environment. For example, when an image scene (such as represented by the input image 130) is a dark scene that is presented for display in a bright ambient light environment, two pixels require an increase in luminance of the step value (e.g., difference value of 3 in a 4-bit greyscale color scheme) before the human eye is able to discern a difference. When the same dark scene is presented for display in a dim ambient light environment, the human eye is generally able to discern a difference at a smaller step value (e.g., difference value of 2 in a 4-bit greyscale color scheme of FIG. 4).

Accordingly, transmitting the input image 130 to the display screen 102 results in a displayed image 402 being perceived by the viewer. However, each of the pixels 404 in the displayed image 402 (e.g., which correspond to the pixels having bit values of 0 and 1 in the input image 130) is separated from each other by a value less than the step value of 2. Accordingly, each of the pixels 404 is perceived as the same shade of black even though the pixels are encoded with different pixel values.

To increase the amount of perceivable detail, in one embodiment, the content adjustment module 116 generates a modified display image 134 by shifting the pixel luminance values of one or more pixels of the input image 130 based on the step value such that more image details are perceivable in the modified display image 134 than the input image 130. For example, as illustrated in FIG. 4, the adjustment module 116 increases the pixel luminance values of pixels 406 and 408 (i.e., 4-bit greyscale value of 2) to be greater than the pixel luminance value of pixel 410 (i.e., 4-bit greyscale value of 0) by at least the step value for this particular viewing environment. Accordingly, transmitting the modified display image 134 to the display screen 102 results in a displayed image 414 being perceived by the viewer, in which the viewer is able to discern between the two black levels corresponding to pixels 406, 408, and 410.

Similarly, the adjustment module 116 adjusts the pixel luminance values of pixels 414 and pixels 416 (which originally are encoded with the same pixel luminance with a 4-bit greyscale value of 8 in the input image 130) such that the pixel luminance values of pixels 414 in the modified display image 134 (i.e., 4-bit greyscale value of 6) differ from the pixel luminance values of pixels 416 in the modified display image 134 (i.e., 4-bit greyscale value of 8) by at least the step value for this particular viewing environment. Accordingly, the viewer is able to discern between the two different greyscale colors in the displayed image 414, thereby increasing the amount of perceivable content than was originally encoded into the input image 130.

In some embodiments, such as when the display screen 102 is a LCD backlit display, a bit value of 0 represents the black level but is perceived as slightly brighter than complete darkness due to the backlight 106 positioned behind the display screen 102. Given the hypothetical display described herein with 4-bit pixel values from 0-15, a pixel value with a 4-bit greyscale value of 0 hypothetically corresponds to 0.05 nits luminance when the backlight level 136 is set to 100% brightness. Similarly, a pixel value with a 4-bit greyscale value of 1 corresponds to 0.1 nits luminance and a pixel value with a 4-bit greyscale value of 2 corresponds to 0.2 nits luminance when the backlight level 136 is set to 100% brightness. Further, a normal room ambient environment may have a minimum viewable threshold of 0.05 nits corresponding to a pixel value of 0 and a dim room ambient environment may have a minimum viewable threshold of 0.025 nits, which is dark than the pixel value of 0 for the backlit LCD display.

However, with an understanding of the backlight 106 characteristics, the backlight adjustment module 118, in various embodiments, adjusts the backlight level 136 in conjunction with the content adjustment module 116 generating the modified image 134 to change an amount of detail perceivable by the user. For example, the hypothetical backlit LCD display is determined to have a linear backlight mapping such that setting the backlight level 136 to 50% will reduce a pixel value luminance by half. Accordingly, the backlight adjustment module 118 can lower the backlight level 136 to 50% when in a dim room ambient environment such that a pixel value of 0 as displayed by the display screen 102 is perceived at 0.025 nits (i.e., the minimum viewable threshold), thereby allowing for display of a luminance value outside of the display's normal capability under normal room ambient environments. Further, it will be appreciated that in various embodiments, the backlight 106 is controllable per local region of a plurality of regions of the display 102 to further increase the range of luminance presentable by the display 102. For example, the backlight 106 can be dimmed only at portions of the display 102 with dark content details to be displayed.

Figure 5:
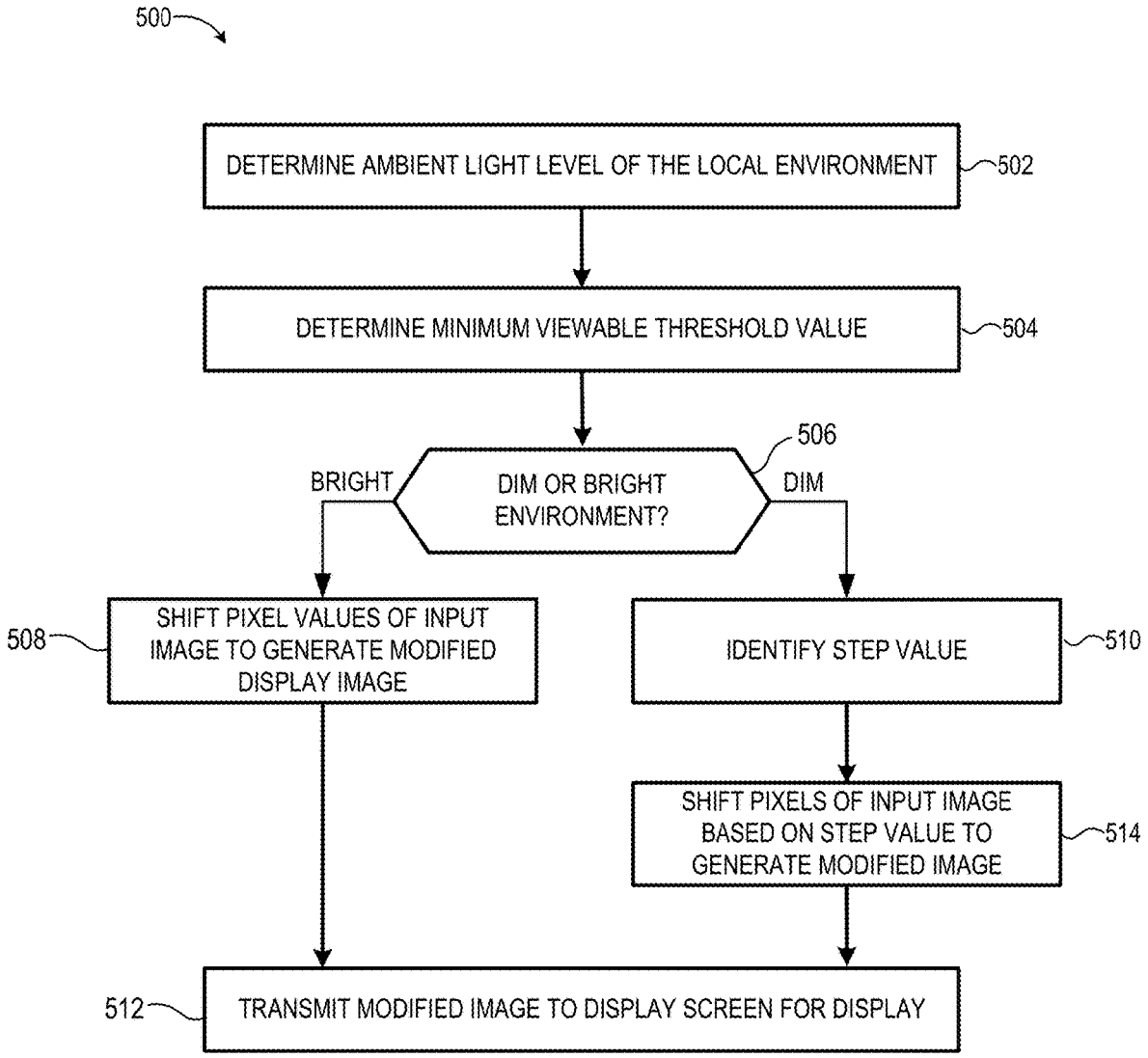
FIG. 5 is a flow diagram of a method for performing dynamic content luminance shifting in accordance with some embodiments.

FIG. 5 is a flow diagram of a method for performing dynamic content luminance shifting in accordance with some embodiments. The method 500 is implemented in some embodiments at the display system 100 of FIG. 1. At block 502, the one or more processors 108 of a display system 100 determines an ambient light level of the local environment 120. In some embodiments, the one or more processors 108 generates ambient light data 126 as output that is in proportion to the amount of ambient light incident on the ambient light sensor 122. In other embodiments, the one or more processors 108 receives image data 128 from a camera 124 and analyzes the image data 128 to determine ambient light conditions of the local environment 120 upon capture.

At block 504, the one or more processors 108 determines, based on the ambient light level, a minimum viewable threshold representing a minimum pixel luminance value receivable by the user in the ambient light level of the local environment, as determined in block 502. In various embodiments, the minimum viewable threshold represents a number of nits luminance (i.e., a measurement of how much light the display screen 102 outputs equal to one candela per square meter—a standardized measurement of luminous intensity) required for a viewer to distinguish details and contrast in dark regions of displayed content. Any pixel luminance values less than the minimum viewable threshold is perceived as the same shade of black.

At block 506, the one or more processors 108 of a display system 100 determines whether the ambient light level corresponds to a bright viewing environment or a dim viewing environment. For example, if the one or more processors 108 determines that the ambient light level is brighter than a first ambient light threshold, the method 500 proceeds to block 508. If instead the one or more processors 108 determines that the ambient light level is dimmer than a second ambient light threshold, the method 500 proceeds to block 510, as described in more detail below.

At block 508, the content adjustment module 116 generates a modified display image 134 by shifting the pixel luminance values of one or more pixels of the input image 130 such that a darkest pixel value of the modified display image 134 is equal to or greater than the minimum viewable threshold. In one embodiment, the content adjustment module 116 raises the black level (i.e., lowest output) of a modified display image 134 transmitted to the display screen 102 for display such that the displayed luminance of the black level is equal to or greater than the minimum viewable threshold for a given viewing environment, thereby preserving visual discernment of details in darker regions of the input image 130. Although discussed here primarily in the context of generating the modified display image 134, various embodiments also include the backlight adjustment module 118 setting a backlight level 136 such that the black level of imagery is equal to or greater than the minimum viewable threshold when the modified display image 134 is displayed at the display screen 102.

In some embodiments, such as described above in more detail relative to FIG. 2, generating the modified display image at block 508 includes identifying a linear shift value representing a difference between the minimum viewable threshold and a darkest pixel value of the input image. The content adjustment module 116 adds the linear shift value to a pixel value of each of a plurality of pixels of the input image. Additionally, in some embodiments, the content adjustment module 116 clamps a pixel value of one or more pixels of the modified display image to be no higher than a max luminance value presentable by the display screen.

The content adjustment module 116 does not necessarily need to shift all pixels of the input image 130 to be equal to or greater than the minimum viewable threshold. For example, such as above in more detail relative to FIG. 3, in some embodiments generating the modified display image includes identifying a linear shift value and adding the linear shift value to a pixel value for each of a first plurality of pixels of the input image to increase a number of pixels in the modified display image equal to or greater than the minimum viewable threshold. However, one or more pixels in the modified display image remain below the minimum viewable threshold.

Additionally, the content adjustment module 116 does not necessarily need to shift all pixels of the input image 130 by the same linear shift value. For example, such as described above in more detail relative to FIG. 3, in some embodiments generating the modified display image includes identifying a second linear shift value lesser than the first linear shift value and adding the second linear shift value to a pixel value for each of a second plurality of pixels of the input image. The adding the second linear shift value to a pixel value for each of a second plurality of pixels of the input image, by content adjustment module 116, results in the modified display image including a second number of pixels having values less than a max luminance value presentable by the display screen.

The linear shifts of block 508, in various embodiments, are identified based on at least one of an average luminance value of pixels in the input image, a minimum luminance value of pixels in the input image, a maximum luminance value of pixels in the input image, a range between the minimum luminance value and the maximum luminance value of pixels in the input image. After block 508, the method 500 proceeds to block 512 at which the one or more processors 108 transmit the modified display image 134 for display at a display screen.

Returning now to block 510, if it is determined that the display system 100 is in a dim environment, the content adjustment module 116 identifies a step value representing a minimum luminance change perceivable from a first pixel to a second pixel by a user in the ambient light level of the local environment.

At block 514, the content adjustment module 116 generates a modified display image 134 by shifting the pixel luminance values of one or more pixels of the input image 130 based on the step value such that more image details are perceivable in the modified display image 134 than the input image 130. For example, such as above in more detail relative to FIG. 4, in some embodiments generating the modified display image 134 includes changing the pixel luminance values of a first plurality of pixels of the input image to generate a first subset and a second subset of the first plurality of pixels, wherein pixel luminance values of pixels in the first subset differ from pixel luminance values of pixels in the second subset by an amount equal to or greater than the step value. After block 514, the method 500 proceeds to block 512 at which the one or more processors 108 transmit the modified display image 134 for display at a display screen.

Figure 6:
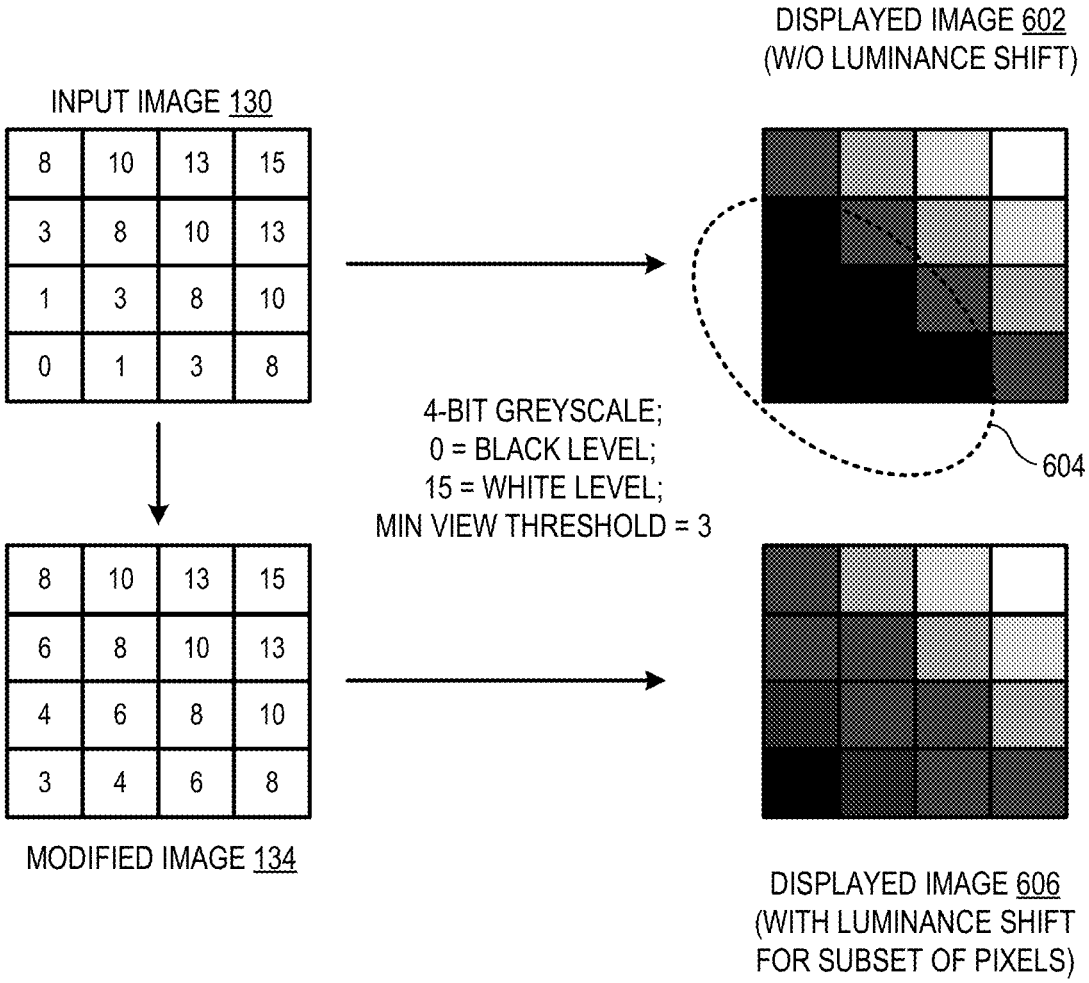
FIG. 6 is a diagram illustrating an example of partial content luminance shifting in accordance with some embodiments.

FIG. 6 is a diagram illustrating an example of partial content luminance shifting in accordance with some embodiments. In the example of FIG. 6, a 4-bit greyscale color scheme and a 4×4 pixel image is provided for ease of illustration and description. In this example 4-bit greyscale color scheme, a bit value of 0 corresponds to the black level and a bit value of 15 corresponds to the white level. However, those skilled in the art will recognize that imagery of any size and various color-coding schemes (e.g., 8-bit color, 10-bit color for HDR, 12-bit color, and the like) may be used without departing from the scope of this disclosure.

As shown, a source image to be output to a display for viewing (e.g., input image 130 of FIG. 1) includes pixels encoded with bit values ranging from 0 to 15. In one example, the display system 100 is in a room with ambient conditions (e.g., as determined by the ambient condition determination module 114 based on the ambient light data 126 and image data 128 of FIG. 1) under which the minimum viewable threshold is at a luminance level corresponding to a 4-bit greyscale value of 3.

Accordingly, transmitting the input image 130 to the display screen 102 results in a displayed image 602 being perceived by the viewer. However, each of the pixels 604 in the displayed image 602 (e.g., which correspond to the pixels having bit values of 0, 1, and 3 in the input image 130) is at or less than the minimum viewable threshold. Accordingly, each of the pixels 604 is perceived as the same shade of black even though the pixels are encoded with different pixel values. In this manner, an amount of detail encoded into the darker regions of the input image 130 is lost due to ambient light conditions of the viewing environment (e.g., local environment 120).

To recover the details such that contrast between the dark pixels is distinguishable without boosting the entire input image 130 with a single linear shift value (e.g., such as described relative to FIG. 2, which can result in clipping near the white level) or applying a compressed luminance shift to pixels near the white level (e.g., such as described relative to FIG. 3), in some embodiments, the content adjustment module 116 determines a number of pixels in each of a plurality of luminance ranges and determines a luminance shift value for increasing the luminance values of a subset of all pixels in the input image 130.

For example, as illustrated in FIG. 6, the content adjustment module 116 determines that the input image 130 includes one pixel with a bit value of 0, two pixels with a bit value of 1, zero pixels with a bit value of 2, three pixels with a bit value of 3, zero pixels with bit values of 4-7, four pixels with a bit value of 8, zero pixels with a bit value of 9, three pixels with a bit value of 10, zero pixels with bit values of 11-12, two pixels with a bit value of 13, zero pixels with a bit value of 14, and one pixel with a bit value of 15. With the input image 130 including pixels with all bit values ranging from a bit value of 0 corresponding to the black level through a bit value of 15 corresponding to the white level, any linear shift value applied to the entirety of the input image 130 (by either increasing or decreasing the pixel value of each of the pixels of the input image 130) will result in a loss of detail.

Based on determining a distribution of bit values for the pixels of input image 130, the content adjustment module 116 identifies that few pixels have bit values in the luminance range corresponding to bit values of 6 through 9. Accordingly, to recover details such that contrast between the dark pixels is distinguishable, the content adjustment module 116 identifies a linear shift value (e.g., 4-bit greyscale value of 3 in this example) and adds the linear shift value to a subset of the pixels of the input image 130. In this example, the content adjust module 116 modifies the input image 130 by adding the linear shift value to any pixels of the input image 130 in the range of bit values 0-5 (i.e., the pixels having bit values of 0, 1, and 3 in the input image 130) while maintaining the bit values of pixels of the input image 130 in the range of bit values 6-15.

In this manner, the content adjustment module 116 modifies the input image 130 by shifting pixels below the minimum viewable threshold up such that the shifted pixels are equal to or greater than the minimum viewable threshold, thereby generating the modified display image 134. In particular, the content adjustment module 116 raises the black level (i.e., lowest output) of the modified display image 134 such that the displayed luminance of the black level is equal to or greater than the minimum viewable threshold for a given viewing environment, thereby preserving visual discernment of details in darker regions of the input image 130 without applying a luminance shift to brighter regions of the input 130 that would otherwise result in clipping and/or white washing of pixels near the white level. Accordingly, transmitting the modified display image 134 to the display screen 102 results in a displayed image 606 being perceived by the viewer. The displayed image 606 includes pixels in the darker regions which are discernable relative to each other (i.e., pixels corresponding to bit values of 3, 4, and 6 of the modified display image 134) and further retains the original image data for pixels in the brighter regions of the input image 130 (i.e., pixels corresponding to bit values of 8, 10, 13, and 15).

A computer readable storage medium may include any non-transitory storage medium, or combination of non-transitory storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

In some embodiments, certain aspects of the techniques described above may implemented by one or more processors of a processing system executing software. The software includes one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A method, comprising:

determining, using one or more processors of a display system, an ambient light level of a local environment proximate a display screen;

determining, using the one or more processors, the ambient light level is brighter than a first ambient light threshold;

determining, based on the ambient light level being brighter than the first ambient light threshold, a minimum viewable threshold representing a minimum pixel luminance value perceivable by a user in the ambient light level of the local environment;

generating, based on the minimum viewable threshold, a modified display image by shifting a pixel luminance value of each pixel of an input image by a same fixed shift value such that a darkest pixel value of the modified display image is equal to or greater than the minimum viewable threshold, the fixed shift value being based at least in part on a defined threshold of pixel contrast loss between pixels in the input image; and transmitting the modified display image for display at a display screen of the display system.

2. The method of claim 1, further comprising:

identifying the fixed shift value based on the defined threshold and on a difference between the minimum viewable threshold and a darkest pixel value of the input image.

3. The method of claim 1, wherein generating the modified display image further comprises:

identifying the fixed shift value and adding the fixed shift value to a pixel value for each of a first plurality of pixels of the input image to increase a number of pixels in the modified display image equal to or greater than the minimum viewable threshold.

4. The method of claim 1, further comprising:

setting a backlight level such that the darkest pixel value is equal to or greater than the minimum viewable threshold when the modified display image is displayed at the display screen.

5. A system, comprising:

an ambient light sensor configured to determine an ambient light level of a local environment proximate a display screen;

an ambient condition determination module configured to determine, based on the ambient light level, a minimum viewable threshold representing a minimum pixel luminance value perceivable by a user in the ambient light level of the local environment; and a content adjustment module configured to generate a modified display image by shifting a pixel luminance value of each pixel of an input image by a same fixed shift value such that a darkest pixel value of the modified display image is equal to or greater than the minimum viewable threshold, the fixed shift value being based at least in part on a defined threshold of pixel contrast loss between pixels in the input image.

6. The system of claim 5, wherein the content adjustment module is configured to:

identify the fixed shift value based on the defined threshold and a difference between the minimum viewable threshold and a darkest pixel value of the input image.

7. The system of claim 5, wherein the content adjustment module is configured to:

identify the fixed shift value and add the fixed shift value to a pixel value for each of a first plurality of pixels of the input image to increase a number of pixels in the modified display image equal to or greater than the minimum viewable threshold.

8. The system of claim 5, wherein the content adjustment module is configured to identify the fixed shift value based on the defined threshold and on at least one of a minimum luminance value of pixels in the input image, a maximum luminance value of pixels in the input image, and a range between the minimum luminance value and the maximum luminance value of pixels in the input image.

9. The system of claim 5, further comprising:

a backlight adjustment module configured to set a backlight level such that the darkest pixel value is equal to or greater than the minimum viewable threshold when the modified display image is displayed at the display screen.

10. The system of claim 5, further comprising:

the display screen.

11. The system of claim 5, wherein the ambient light sensor comprises at least one of: a photodiode or a phototransistor.

12. A method, comprising:

determining, using one or more processors of a display system, an ambient light level of a local environment proximate the display system;

determining, using the one or more processors, the ambient light level is dimmer than a first ambient light threshold;

determining, based on the ambient light level being dimmer than the first ambient light threshold, a step value representing a minimum luminance change perceivable from a first pixel to a second pixel by a user in the ambient light level of the local environment;

generating, using the one or more processors, a modified display image by shifting a pixel luminance value of each pixel of an input image by a same fixed shift value that is based on the step value and on a defined threshold of pixel contrast loss between pixels in the input image, such that more image details are perceivable in the modified display image than the input image; and transmitting the modified display image for display at a display screen of the display system.

13. The method of claim 12, further comprising:

determining, based on the ambient light level, a minimum viewable threshold representing a minimum pixel luminance value perceivable by the user in the ambient light level of the local environment; and determining, using the one or more processors, the fixed shift value so that a darkest pixel value of the modified display image is equal to or greater than the minimum viewable threshold.

14. The method of claim 13, further comprising:

determining a backlight level such that the darkest pixel value is equal to or greater than the minimum viewable threshold when the modified display image is displayed at the display screen.

15. The method of claim 13, wherein the fixed shift value is determined based on the defined threshold and on at least one of an average luminance value of pixels in the input image, a minimum luminance value of pixels in the input image, a maximum luminance value of pixels in the input image, and a range between the minimum luminance value and the maximum luminance value of pixels in the input image.

* * * * *